US005752761A

United States Patent [19]

Pietruczynik et al.

[11] Patent Number: 5,752,761

[45] Date of Patent: May 19, 1998

[54] HIGH VISIBILITY FLASHLIGHT

[75] Inventors: Kris B. Pietruczynik; Kevin W. Kouba; Linda M. Csont, all of Madison, Wis.

[73] Assignee: Rayovac Corporation, Madison, Wis.

[21] Appl. No.: 605,352

[22] Filed: Feb. 22, 1996

[51] Int. Cl.[6] ..... F21V 9/16

[52] U.S. Cl. ..... 362/84; 362/208; 250/462.1; 252/301.35

[58] Field of Search ..... 362/84, 157, 208, 362/202; 250/462.1; 252/301.35

[56] References Cited

U.S. PATENT DOCUMENTS

| | | | |
|---|---|---|---|
| 3,796,869 | 3/1974 | Stone | 362/84 |
| 3,915,884 | 10/1975 | Kazenas | 252/301.2 R |
| 3,922,232 | 11/1975 | Schein | 252/301.2 R |
| 4,546,416 | 10/1985 | Pemberton | 362/84 |
| 5,135,568 | 8/1992 | Fasano | 252/301.35 |
| 5,172,937 | 12/1992 | Sachetti | 250/462.1 |

FOREIGN PATENT DOCUMENTS

| | | | |
|---|---|---|---|
| 1144837 | 4/1957 | France | 362/157 |

OTHER PUBLICATIONS

"Update: Special-effects Colorants," Plastics Compounding, pp. 33–36, Nov./Dec. 1992.

*Plastics Compounding 1994/95 Redbook*, p. 52.

*Encyclopedia of Chemical Technology*, 1981, pp. 527–569.

*Encyclopedia of Polymer Science and Engineering*, 1985 pp. 746–759.

*Plastics Additives and Modifiers Handbook*, 1992, pp. 871–928.

Day-Glo Technical Bulletin.

*Primary Examiner*—Thomas M. Sember

*Attorney, Agent, or Firm*—Thomas D. Wilhelm; Brian R. Tumm

[57] ABSTRACT

This invention pertains to a flashlight body. Either the main body or at least one closure cap has a luminescent outer surface. The outer surface comprehends a luminescent colorant composition in the base material. At least 50% by weight, up to 100% by weight, of the colorant composition in the base material is luminescent. No more than 50% by weight, of the colorant composition comprises reflective colorant material. Thus, the flashlight body emits, in the visible spectrum, light radiation derived in part from the reflective colorant material and in part from the luminescent colorant material. Light emitted from the luminescent colorant adds to the intensity of the light reflected by the reflective colorant to provide total emitted light intensity, from the flashlight body, greater than the light intensity from a corresponding amount of the reflective colorant alone, and characteristic fluorescent glow.

22 Claims, 1 Drawing Sheet

HIGH VISIBILITY FLASHLIGHT

FIELD OF THE INVENTION

This invention relates to flashlights and flashlight components. More specifically, this invention relates to flashlight bodies, and facilitating location of same by the user.

BACKGROUND OF THE INVENTION

Flashlights have gained widespread use as portable sources of light. Flashlights are commonly used as convenient sources of light when it is more convenient to use the flashlight than to obtain light from a hard wired (e.g. commercial) energy grid such as the grid represented by the wiring system of a building. Flashlights are also commonly used at locations remote from terminals in a commercial energy grid. In addition, flashlights are commonly used in emergency situations, such as at fire scenes, accident scenes, and the like where it is critical to obtain an immediate and highly portable source of light.

Since flashlights are used to provide light, they are commonly used in low light environments. In such low light environment, a first obstacle for the user is to locate the flashlight. Particularly in an emergency situation, it may be critical to locate the flashlight quickly.

There has been a long felt and unmet need to provide economical, efficient flashlights which are easy to locate. However, flashlights available commercially generally do not meet the perceived need. Commercially available flashlights are generally dark in color, making them difficult to locate.

To solve this problem, the industry has provided sensory alerting sources on the flashlight body, to assist in locating the flashlight. In a first such effort, flashlights have been provided with light emitting diodes (LED's) on the outside of the flashlight body. The LED's are small in size, thus limiting their practical use where the flashlight may be partially covered by another object. In addition, the LED's use power from the flashlight batteries, thus shortening the effective use life of the batteries.

In a second effort to solve the problem of making the flashlight easy to locate, flashlights have been provided which incorporate audible signals that can be activated remotely. As with the LED effort, such alarms use the flashlight battery to power the alarm, with the accompanying shortening of the use life of the flashlight batteries. Further, such alarms may require a remote transmitter and associated battery and/or a receiver on the battery for detecting the remote transmission. Such requirements add to the cost of the battery system, and in the case of a remote transmitter, add the necessity to find the remote transmitter when the flashlight is needed.

Thus, even though the need for easy location of the flashlight is known, and significant effort has been expended in resolving this need, there remains a need for a flashlight which can be easily located without using energy from the flashlight battery.

Accordingly, it is an object of this invention to provide a flashlight which is easy to locate without using any energy from the battery contained in the flashlight.

It is another object to provide a flashlight which is easy to locate visually.

It is yet another object to provide a flashlight having luminescent properties at its outer surface.

It is still another object to provide a flashlight having fluorescent properties at its outer surface.

Still other objects are embodied in flashlight bodies which are easily located visually, preferably according to luminescent properties of the outer surface of the flashlight body.

SUMMARY OF THE INVENTION

Some of the objects are obtained in a first family of embodiments comprehending a flashlight having a main body and at least one closure cap. At least one of the main body and the at least one closure cap comprises a luminescent body having an outer colored region thereof, including an outer surface. The outer colored region comprises a base material, and a colorant composition in the base material. At least 50% by weight, up to 99.9% by weight, of the colorant composition in the base material comprises a luminescent colorant material receiving first energy as incident radiation at a first wavelength and emitting the first energy at a second longer wavelength in the visible spectrum. At least 0.1% by weight, up to 50% by weight, of the colorant composition comprises reflective colorant material receiving second energy as incident radiation at a third wavelength in the visible spectrum and selectively reflecting the second energy so received at a fourth wavelength in the visible spectrum at or near the second wavelength. Thus, at least one of the main body and the at least one closure cap emits, in the visible spectrum, light radiation derived in part from the reflective colorant material and in part from the luminescent colorant material. The light emitted from the luminescent colorant material adds to the intensity of the light reflected by the reflective colorant material to provide a total emitted light intensity, from the combination of the reflective colorant material and the luminescent colorant material, greater than the light intensity emitted by a corresponding amount of the reflective material alone.

Preferably, the luminescent material is carried in a polymeric carrier.

In preferred embodiments, the colorant composition comprises the luminescent material, a reflective non-white colorant, preferably a phthalocyanine colorant, and a reflective white colorant providing both opacity and brightness.

It is preferred that the luminescent colorant material be carried in a particulate polymer carrier such as an amide polymer. The particulate polymer carrier is dispersed in a polymeric base material which can be any polymeric material compatible with receiving the particulate polymer carrier and the luminescent colorant and its particulate e.g. amide carrier. Typical polymeric base materials are polystyrene or a polyolefin. Of the polyolefins, polyethylene and polypropylene are preferred.

The luminescent material may be a fluorescent colorant, or a phosphorescent colorant.

In preferred embodiments, at least part of the energy emitted by the luminescent material is derived from incident light having a wavelength shorter than the wavelength of visible light. Light emitted from the main body at the dominant wavelength typically represents at least 15%, and up to 300%, of the radiation incident at the emitted wavelengths.

Figure 1:
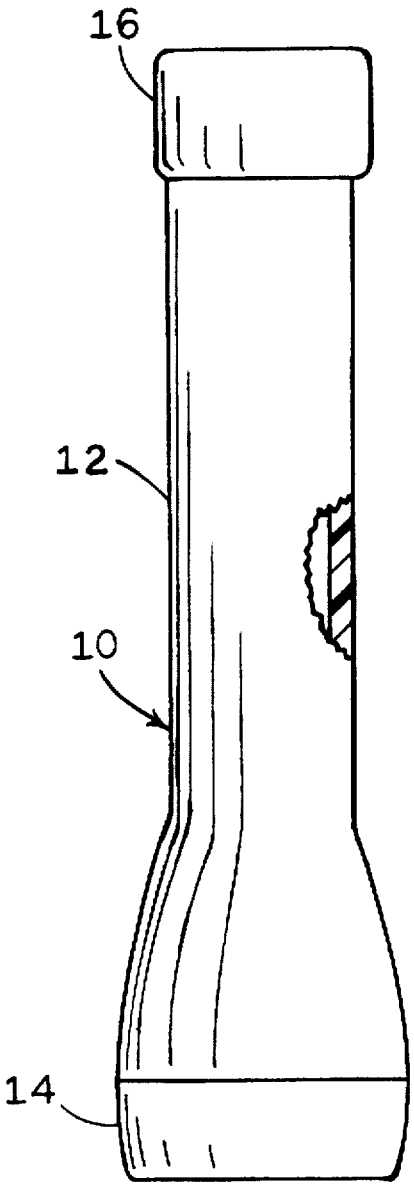
FIG. 1 shows a flashlight, partially cut away, illustrating the principles of the invention.

The invention is not limited in its application to the details of construction and the arrangement of the components set forth in the following description or illustrated in the drawings. The invention is capable of other embodiments or of being practiced or carried out in various ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 2:
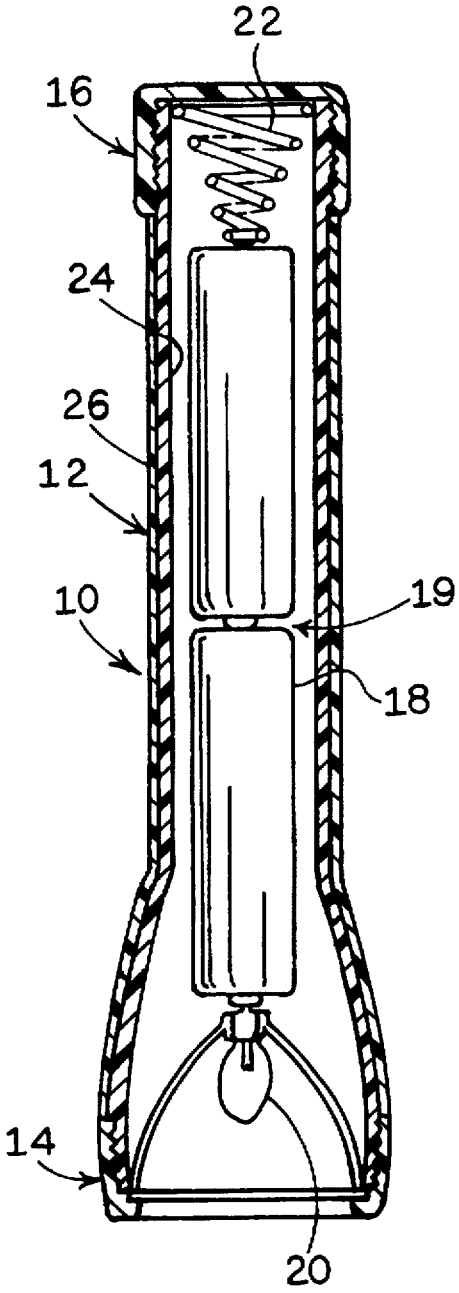
FIG. 2 shows a cross-section of the flashlight as in FIG. 1, illustrating the luminescent characteristics of the invention.

FIGS. 1 and 2 show a flashlight 10 of the invention. The flashlight includes a main body 12, and a pair of closure caps, namely a lens cap 14, and an end cap 16. Also shown are two batteries 18, in battery chamber 19, connected in series to an end of a bulb 20 in lens cap 14. Spring 22 bridges between end cap 16 and the other end of the series of batteries.

As shown, main body 12 includes a substrate layer 24, and an outer layer 26. The substrate layer 24 is preferably plastic, preferably such as polystyrene or a polyolefin. Of the polyolefins, polypropylene and polyethylene, especially high density polyethylene, are preferred. The composition of substrate layer 24 is not critical so long as the fluorescent colorant is incorporated in the outer layer. Thus, the substrate layer 24 may, in general, be constructed of other materials such as, for example, metal. In any event, normal additives and processing aids may generally be used in fabricating substrate layer 24.

The outer layer 26 is a plastic compatible with the substrate layer and bonded to the substrate layer. Outer layer 26 contains a colorant composition adapted to make the flashlight highly visible. The colorant composition in layer 26 makes the main body 12 brighter than the brightness obtainable with a corresponding amount of conventional reflective colorant material.

In preferred colorant compositions used in the outer layer 26, the dominant colorant element is luminescent colorant material. Preferred luminescent colorant materials are daylight fluorescent colorants. Daylight fluorescent colorants respond with fluorescence to, for example, daylight, daylight fluorescent light, cool white fluorescent light, and incandescent light. Daylight fluorescent colorants exhibit normal reflective coloration behavior and, in addition, absorb radiant energy of certain wavelengths, typically shorter than radiation in the visible spectrum, and after a fleeting instant, emit part of the absorbed energy as quanta of energy, of longer wavelength than the absorbed energy, in the visible spectrum.

Thus, in contrast to ordinary reflective colorants in which the absorbed energy is converted entirely to heat, some of the light absorbed at wavelengths below the emission wavelengths is emitted from a fluorescent colorant at the emission wavelength, adding to the light returned by simple reflection, to give the "extra glow" characteristic of a daylight-fluorescent material. While conventional reflective colorants emit no more than 10% of the incident light at a given wavelength, daylight fluorescent colorants typically emit at least 20% to 30% of the light incident at a given wavelength. Daylight fluorescent colorant materials can emit, at a given range of wavelengths, as much as 3 times the amount of energy received at the given wavelength. Thus, at a given wavelength, an article colored with daylight fluorescent colorant material can emit more energy than was received at that wavelength because of the additive effect of energy received at lower wavelengths and emitted at the longer emission wavelength.

The terms "wavelength" and "wavelengths" as used herein with respect to emissions refer to ranges of wavelengths over which radiant energy is emitted.

The period of emission is generally coexistent with the period of incident energy, also known as the period of excitation. However, zinc sulfide is available as a phosphorescent colorant, useful in this invention, wherein incident energy is stored and given off over a period of time, including after the incident radiation is no longer being received. Thus, zinc sulfide provides glow-in-the-dark properties as a luminescent colorant. The glow-in-the-dark properties, of course, greatly assist in locating the flashlight in low light, or no light, conditions.

Daylight fluorescent colorant generally consists of organic dye material, and is generally dispersed in solvent/solute relationship in colorless brittle resins such as amide polymer as a solidified solution. Methods of making such dispersions, and the dispersions so made, are taught in U.S. Pat. No. 3,915,884 to Kazenas, herein incorporated by reference. Polyester polymer is also acceptable as the carrier polymer for fluorescent dyes. Examples of acceptable polyester carrier polymers, and methods of making them, and dispersions using such polymers, are taught in U.S. Pat. No. 3,922,232 to Schein, herein incorporated by reference. Less preferred carriers include, but are not limited to, melamine formaldehyde and toluene sulfonate. Concentration of the daylight fluorescent colorant in the carrier resin is typically 1–10% by weight.

The brittle polymer, with the fluorescent dye therein, is ground to pigment-size particles of the order of about one micron, whereupon the reduced-size solid state particles are considered pigments, are treated like pigments, and generally function like pigments. Such fluorescent pigments contain fluorescent dyestuffs that not only provide reflective color but are capable of intense fluorescence in the solid solution within which they are contained.

The colorants used herein should in general be compatible with the process temperatures and times of extrusion injection molding. Thus, the colorants must be stable at high temperatures of plastic melts, for extended periods of time without degradation.

Examples of fluorescent colorants suitable for use in making fluorescent pigments are rhodamine B, auramine and thioflavine T, naphthalimide yellows, coumarin yellows, benzothioxanthene, and benzoxanthene. Graphs of typical emission spectra of fluorescent colorants are shown at page 921 in "Plastics Additives and Modifiers Handbook," published by Van Nostrand Reinhold, New York, N.Y., 1992. The graphs of emission spectra shown therein illustrate the ranges of wavelengths over which the daylight fluorescent colorants emit light energy.

The fluorescent pigments, now solvated in e.g. polyamide carrier resin, with the polyamide carrier resin configured as micron-sized particles, are typically dispersed in a receiving concentrate resin such as one of the polyolefins, for example polypropylene or polyethylene. Generally the receiving resin is melted, and the colorant is dispersed in the receiving resin while the receiving resin is in the melted state, to make resulting color concentrate resin.

The melted color concentrate resin can be passed directly to processing equipment such as injection molding equipment for injection molding flashlight bodies. In the alternative, the color concentrate resin can be extruded and formed into e.g. solid color concentrate pellets. The color concentrate pellets can be stored for use at a more convenient time or place.

Additional particulate, and especially reflective, colorants can also be dispersed in the concentrate resin. The overall loading of such pigment particles, including the fluorescent material and the reflective colorants, can be up to about 50% by weight pigment.

Daylight fluorescent colorants are well known, commercially available materials, as reported in e.g. "The Encyclopedia of Chemical Technology," Kirk Othmer, published by John Wiley & Sons, New York, N.Y., 1981, pages 546–547. Any of the known fluorescent colorants are acceptable for use in the invention. However, daylight-fluorescent materials are available only in a limited number of colors. Thus the inventors herein prefer to use the fluorescent material in combination with small amounts of reflective colorants in order to obtain desired overall shades of color.

As a second element of the colorant composition, a second (reflective) and preferred colorant material is selected from the non-white (e.g. phthalocyanine) colorants. In general, the phthalocyanine colorants contain copper tightly bound in polycyclic structures, within a nitrogen substructure, the entire structure being stabilized by aromatic benzene rings and derivatives. An exemplary structure for phthalocyanine colorant is shown following. Modest modifications from the structure shown provide alternative colors.

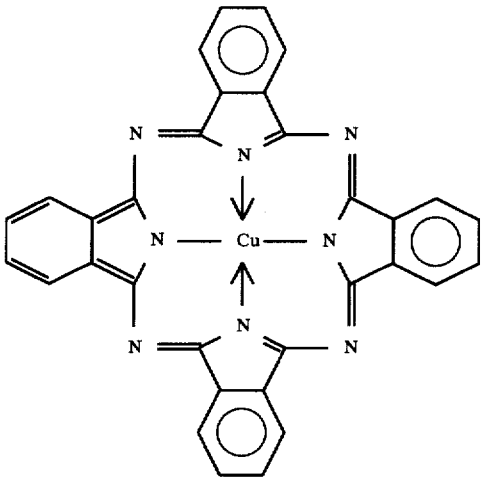

Phthalocyanine Blue (PB 15)

Known acceptable phthalocyanine pigments are Pigment Blue 15:1 (alpha modification, reddish), Pigment Blue 15:2 (beta modification, greenish), Pigment Green 7 (medium green), and Pigment Green 36 (yellowish), all as discussed in "Plastics Additives and Modifiers Handbook," mentioned above, at page 893. Other reflective colorants can be used in place of, or in addition to, the phthalocyanine colorants disclosed here. Thus, the specific nature of the reflective colorants is not critical, as the only purpose of the reflective colorant is to provide the desired shade of color to the finished product. Accordingly, any reflective colorant compatible with the process conditions can be used in place of the phthalocyanine colorant specifically illustrated here.

Finally, it is preferred to include, as a third element in the colorant combination, a reflective colorant that lightens the resultant color mixture, and adds opacity to the overall product. Preferred lightener/opacifier is titanium dioxide ($TiO_2$). Also acceptable is zinc sulfide.

As suggested above, the overall colorant combination comprises the fluorescent colorant, the phthalocyanine reflective colorant, and the titanium dioxide reflective colorant. The purpose of the fluorescent colorant is to provide the fluorescent "glow." The purpose of the phthalocyanine colorant is to provide the desired shade of color (e.g. a particular green). The purpose of the titanium dioxide is two-fold. First the titanium dioxide is an opacifier, providing opacity to the resultant product. Second the titanium dioxide, being white, tends to make the color appear lighter than without the titanium dioxide, thus affecting the "darkness/lightness" of the resultant shade of color.

Suitable solid fluorescent colorants can be obtained as fluorescent pigment in a polyamide resin base from Day-Glo Color Corporation, Cleveland, Ohio, as e.g. Signal Green ZQ Pigment or Saturn Yellow ZQ Pigment. Such colorants may be fabricated into pellets of color concentrate by dispersing the colorants in a carrier resin such as polypropylene. Such concentrates are available from M. A. Hanna Color Company, Gastonia, N.C.

"Colorant composition" as used herein with respect to amounts of colorant, refers only to the colorant elements, themselves, without reference to any carrier in which they may be dissolved or otherwise carried. Thus, "colorant composition" does not include the polymer carrier (e.g. polyamide) in which the fluorescent colorant material may be dissolved, or the concentrate resin in which pigments may be carried.

Regarding relative amounts of the three colorant elements in the colorant composition, the fluorescent colorant material is necessarily present in dominant amount. Indeed, the fluorescent colorant may be the only colorant used. The greater the amounts of the reflective phthalocyanine and titanium dioxide materials, the more the reflective colorant materials tend to "quench" the "extra glow" fluorescent properties of the fluorescent colorant material. Accordingly, the fluorescent colorant material generally comprises at least 50%, preferably at least 80%, of the overall colorant composition. In some embodiments, the fluorescent material comprises at least 90% of the colorant composition. The fluorescent material can comprise 99.9% of the colorant composition, indeed all of the colorant composition used.

However, as the relative amount of the fluorescent material increases, the relative amounts of reflective colorant materials decrease. As the relative amounts of the reflective colorant materials decrease, so do their contributions to lightness and color shade. Thus, in general, the reflective colorants are preferably present, in combination, in amounts of at least about 2% by weight, preferably at least about 5% by weight, but less than 20%. However, in some embodiments, up to 33% reflective colorant is preferred.

To make the main body 12 of the flashlight, an appropriate amount of pellets of the color concentrate is mixed with pellets of the generally colorless primary resin from which main bodies are to be made (e.g. polypropylene). The mixture of primary resin pellets and color concentrate pellets is processed through an appropriate extruder, and molded in a suitable injection molding die or the like.

The colorants used herein can be applied in either solid or liquid state. Where the colorant is used in liquid state, the colorant along with suitable carrier oils and surfactants, and other additives, is injected at appropriate location, into the extruder, using well known liquid injection procedures. Suitable liquid colorants are available from Riverdale Color Manufacturing Inc., Brooklyn, N.Y., as, for example, Fluorescent Green, product Number 5964. In some embodiments, the colorant composition is obtained and used, in whole or in part, as a solid particulate powder wherein the particle size is generally greater than 1 micron and less than 2 millimeters.

It is entirely acceptable, and indeed preferred, that the main body 12 of the flashlight be made with a single layer of material in place of the substrate layer 24 and outer layer 26. The single layer embodiment is illustrated in the cutaway portion shown in FIG. 1. Accordingly, in such embodiments, the flashlight body is e.g. injection molded using a single layer die mounted on a single extruder. In accord with the single layer structure, the above colorant materials are preferably distributed throughout the thickness of the main body. Thus, the colorant elements which establish opacity operate over the greater thickness, typically making them more effective.

Normal additives and processing aids, such as antioxidants and stabilizers, can be used in the several plastic fabricating steps. Such fabricating steps include incorporating the fluorescent die into the e.g. amide polymer carrier to make fluorescent pigment, reducing the particle size of the fluorescent pigment, incorporating the fluorescent pigment and/or other pigments into a concentrate resin, and mixing, extruding, and molding the concentrate resin with a base e.g. polypropylene resin to make e.g. layer 26 or the entire flashlight body or cap.

While the above description discusses fluorescent colorants, which emit light energy only during the period of excitation, the invention comprehends other embodiments wherein the luminescent colorant material is a phosphorescent material such as zinc sulfide. Phosphorescent material stores some of the incident energy, and gradually gives off the stored energy as visible light over a period of time, including after excitation is terminated. Thus a phosphorescent body gives off light in the dark for a period of time after light sources are removed. Thus, external members of a flashlight made with phosphorescent colorant materials have a glow-in-the-dark property for a period of time after external light sources have been removed.

The above description discusses a highly visible flashlight in terms of the main body being highly visible. The invention also contemplates that less than all of the main body may contain the luminescent colorant material, and thus less than all of the main body may be highly visible in the context taught here.

In alternate embodiments, the main body 12 may not include the luminescent colorant material and thus is not necessarily highly visible. However, the lens cap 14 and/or end cap 16 incorporate the luminescent colorant material such that the respective lens cap 14 and/or the end cap 16 are highly visible. In such embodiments, the extremities of the flashlight, as opposed to the main body portion in the middle of the flashlight, are designed to be highly visible. By making the extremities of the flashlight highly visible, there is a greater probability that an object lying on top of the flashlight will not cover all highly visible surfaces of the flashlight, giving the user a better opportunity to visually locate the flashlight.

In yet another embodiment, the main body 12, as well as one or both of the lens cap 14 and the end cap 16, incorporate ones of the above discussed luminescent colorants whereby they are all highly visible.

In general, substrate layer 24 need not be colored. However, in some embodiments, the substrate layer may be colored to provide opacity and/or brightness in support of the fluorescent colorant used in the outer layer. To that end, especially the supportive, non-fluorescent colorants recited herein for use in the outer layer can be used, in whole or in part, in the substrate layer. To the extent supportive colorants are used in substrate layer 24 instead of in outer layer 26, outer layer 26 has increased capacity for receiving additional fluorescent colorant material.

To this point, this teaching describes the fluorescent colorant in only outer layer 26. In some embodiments, some or all of the fluorescent colorant is incorporated into the substrate layer 24. Thus, the outer layer can be substantially free of additive colorant material, whereby the outer layer may be colorless except for color naturally present in the polymeric materials used as the outer layer. In such case, the supportive colorants are preferably used only in the substrate layer such that the only colorant in the outer layer, if any, is a portion of the fluorescent colorant. In these embodiments, supportive colorant material may be present in the outer layer. However, the fraction of the supportive colorant which is present in the outer layer is no greater than the fraction of the fluorescent colorant which is present in the outer layer.

It should be understood that the flashlight elements described herein, made with fluorescent colorants, can have only one layer, or can have the two layers shown in the drawings. In addition, third, fourth, and higher number layers can be used so long as they do not substantially interfere with the colorant effect of the colored layer or layers. The additional layers may or may not be colored. Those skilled in the art of coloring will see that various layers can be used to supply various colorant properties in beneficial ways. Thus, for example, each colorant may be supplied in its own layer, or two or more colorants may be combined in a single layer while other colorants are supplied in one or more other layers. Further, colorless layers and coatings may be provided outwardly in the colored flashlight body elements for other than coloring purposes. For example, graphics or information can be printed on the outer surface of outer layer 26 with print media which are not resistant to abrasion or other abuse. Thus, a protective coating or layer can be provided outwardly of outer layer 26 to protect the print media. All such additional coatings and layers are within the scope of the invention.

As used herein, the term "flashlight" includes any portable light, including lights commonly known as lanterns.

Those skilled in the art will now see that certain modifications can be made to the articles and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A main body for a flashlight, said main body comprising a battery chamber for receiving a battery thereinto, said main body further comprising an outer colored region thereof, including an outer surface, said outer colored region, including an outer surface, comprising a base material, and a colorant composition in said base material, at least 50% by weight of said colorant composition comprising a luminescent colorant material receiving first energy as incident radiation at a first wavelength and emitting the first energy at a second longer wavelength in the visible spectrum, at least 0.1% by weight of said colorant composition comprising reflective colorant material receiving second energy as incident radiation at a third wavelength in the visible spectrum and selectively reflecting the second energy so received at a fourth wavelength in the visible spectrum at or near the second wavelength, such that said main body emits, in the visible spectrum, light radiation derived in part from said reflective colorant material and in part from said luminescent colorant material, the light emitted from said luminescent colorant material adding to the intensity of the light reflected by said reflective colorant material to provide a total emitted light intensity, from the combination of the reflective colorant material and the luminescent colorant material, greater than the light intensity from a corresponding amount of said reflective colorant material alone.

2. A main body for a flashlight as in claim 1, said luminescent material being carried in a polymeric carrier.

3. A main body for a flashlight as in claim 2, said colorant composition comprising said luminescent material, a reflecting non-white phthalocyanine colorant, and a white colorant providing both opacity and brightness.

4. A main body for a flashlight as in claim 2, said luminescent material being carried in a particulate amide polymer carrier, said particulate amide polymer carrier being dispersed in a polypropylene base material.

5. A main body for a flashlight as in claim 1, said luminescent material comprising a fluorescent colorant.

6. A main body for a flashlight as in claim 1, said luminescent material comprising a phosphorescent colorant.

7. A main body for a flashlight as in claim 1, at least part of the energy emitted by said luminescent material being derived from incident light having a wavelength shorter than the wavelength of visible light.

8. A main body for a flashlight as in claim 1 wherein light emitted from said main body at the dominant wavelength represents at least 15%, and up to 300% dominant wave radiation incident at the dominant wavelength.

9. A main body for a flashlight as in claim 1, at least 50% by weight of said colorant composition comprising said luminescent colorant material, no more than about 50% by weight of said colorant composition comprising said reflective colorant material.

10. A flashlight having a main body and at least one closure cap, said main body comprising a luminescent body having an outer colored region thereof, including an outer surface, said outer colored region comprising a base material, and a colorant composition in said base material, at least 80% by weight of said colorant composition comprising a luminescent colorant material receiving first energy as incident radiation at a first wavelength and emitting the first energy at a second longer wavelength in the visible spectrum, at least 0.1 by weight of said colorant composition comprising reflective colorant material receiving second energy as incident radiation at a third wavelength in the visible spectrum and selectively reflecting the second energy so received at a fourth wavelength in the visible spectrum at or near the second wavelength, said reflective colorant material comprising the combination of a reflecting non-white colorant and a white colorant material providing both opacity and brightness, such that said main body emits, in the visible spectrum, light radiation derived in part from said reflective non-white colorant, in part from said white colorant material, and in part from said luminescent colorant material, the light emitted from said luminescent colorant material adding to the intensity of the light reflected by said non-white reflective colorant and said white colorant material to provide a total emitted light intensity, from the combination of the reflective non-white colorant, the white colorant material, and the luminescent colorant material, greater than the light intensity from a corresponding amount of said reflective material alone.

11. A flashlight as in claim 10, said luminescent material being carried in a polymeric carrier.

12. A flashlight as in claim 11, said reflective non-white colorant material comprising a phthalocyanine colorant.

13. A flashlight as in claim 10, said luminescent material being carried in a particulate amide polymer carrier, said particulate amide polymer carrier being dispersed in a polypropylene base material.

14. A flashlight as in claim 10, said luminescent material comprising a fluorescent colorant.

15. A flashlight as in claim 10, said luminescent material comprising a phosphorescent colorant.

16. A flashlight as in claim 10, at least part of the energy emitted by said luminescent material being derived from incident light having a wavelength shorter than the wavelength of visible light.

17. A flashlight as in claim 10 wherein light emitted from said main body at the dominant wavelength represents at least 15%, and up to 300%, of the radiation incident at the dominant wavelength.

18. A flashlight as in claim 10, at least 80% by weight of said colorant composition comprising said luminescent colorant material, less than 20% by weight of said colorant composition comprising said reflective colorant material.

19. A flashlight as in claim 10, said flashlight including a lens cap, said lens cap including no luminescent colorant material.

20. A flashlight having a main body, said main body comprising a battery chamber for receiving a battery thereinto, said main body further comprising an outer colored region thereof, including an outer surface region, said outer colored region, including an outer surface, comprising a base material, and a colorant composition in said base material, at least 50by weight of said colorant composition comprising a luminescent colorant material receiving first energy as incident radiation at a first wavelength and emitting the first energy at a second longer wavelength in the visible spectrum, at least 0.1% by weight of said colorant composition comprising reflective colorant material receiving second energy as incident radiation at a third wavelength in the visible spectrum and selectively reflecting the second energy so received at a fourth wavelength in the visible spectrum at or near the second wavelength, said reflective colorant material comprising a reflecting non-white colorant, said reflective colorant material further comprising a white colorant material providing both opacity and brightness, such that said main body emits, in the visible spectrum, light radiation derived in part from said reflective non-white colorant, in part from said white colorant material, and in part from said luminescent colorant material, the light emitted from said luminescent colorant material adding to the intensity of the light reflected by said reflective colorant material to provide a total emitted light intensity, from the combination of the reflective colorant material and the luminescent colorant material, greater than the light intensity from a corresponding amount of said reflective colorant material alone.

21. A flashlight as in claim 20 wherein said colorant composition is distributed throughout substantially the entirety of said main body.

22. A main body for a flashlight as in claim 1 wherein said colorant composition is distributed throughout substantially the entirety of said main body.

* * * * *